US012453425B2

(12) United States Patent
Shih et al.

(10) Patent No.: US 12,453,425 B2
(45) **Date of Patent: *Oct. 28, 2025**

(54) LOW-PROFILE ELECTRIC BED

(71) Applicant: Chuan-Hang Shih, Lukang Township, Changhua County (TW)

(72) Inventors: Chuan-Hang Shih, Lukang Township (TW); Yu-Chi Yang, Lukang Township (TW)

(73) Assignee: Chuan-Hang Shih, Lukang Township, Changhua County (TW)

( * ) Notice: Subject to any disclaimer, the term of this patent is extended or adjusted under 35 U.S.C. 154(b) by 64 days.

This patent is subject to a terminal disclaimer.

(21) Appl. No.: 18/598,562

(22) Filed: Mar. 7, 2024

(65) Prior Publication Data

US 2025/0280965 A1 Sep. 11, 2025

(51) Int. Cl.
*A47C 20/10* (2006.01)

(52) U.S. Cl.
CPC ..... *A47C 20/10* (2013.01)

(58) Field of Classification Search
CPC ..... A47C 20/00; A47C 20/021; A47C 20/027; A47C 20/04; A47C 20/041; A47C 20/043; A47C 20/045; A47C 20/046; A47C 20/08; A47C 20/10; A47C 19/005
See application file for complete search history.

(56) References Cited

U.S. PATENT DOCUMENTS

| | | | | |
|---|---|---|---|---|
| 5,579,550 | A * | 12/1996 | Bathrick | A47C 19/005 5/618 |
| 11,839,307 | B2 * | 12/2023 | Wang | A47C 20/12 |
| 2018/0235373 | A1 * | 8/2018 | Tsai | A47C 20/08 |
| 2020/0054144 | A1 * | 2/2020 | Shih | F15B 15/1457 |
| 2020/0367660 | A1 * | 11/2020 | Tsai | A47C 20/04 |
| 2021/0393043 | A1 * | 12/2021 | Wang | A47C 20/041 |
| 2022/0022659 | A1 * | 1/2022 | Chung | A47C 20/041 |
| 2022/0248863 | A1 * | 8/2022 | Shan | A47C 20/041 |
| 2022/0330706 | A1 * | 10/2022 | Chen | A47C 20/041 |

* cited by examiner

*Primary Examiner* — George Sun
(74) *Attorney, Agent, or Firm* — Birch, Stewart, Kolasch & Birch, LLP

(57) ABSTRACT

A low-profile electric bed includes a stationary frame having two slide rails, an upper frame pivotally connected with the stationary frame, a push frame having a swivel rack pivotally connected with the upper frame and two moving arms pivotally connected with swivel rack, and an actuator having two ends pivotally connected with the stationary frame and the upper frame, respectively. The actuator is arranged in a way that when the actuator extends, the upper frame is driven to upward swing relative to the stationary frame. As a result, the low-profile electric bed may have a reduced thickness to minimize packing volume thereof while maintaining a normal function.

5 Claims, 5 Drawing Sheets

LOW-PROFILE ELECTRIC BED

BACKGROUND OF THE INVENTION

1. Field of the Invention

The present invention relates generally to an electric bed and more particularly, to a low-profile electric bed having a thin thickness.

2. Description of the Related Art

Conventional electric beds are basically composed of essential parts, such as base frame and back, buttock, thigh and lower leg supporting frames located on the base frame, as well as two actuators, such as electric cylinders, mounted to the base frame for driving the back supporting frame and the thigh supporting frame to swing respectively. To get a longer force arm, the back supporting frame and the thigh supporting frame are usually and respectively provided with a downwardly extending support arm to be connected with one of the two actuators, such that the actuators may generate sufficient torque to drive the back supporting frame and the thigh supporting frame to swing.

Since the two support arms each have a considerable length, they may extend downward beyond the bottom surface of the base frame. If the base frame is intended to be placed on the ground or bed surface, it needs to have sufficient thickness to accommodate these two support arms. As a result, the packing volume of a conventional electric bed is larger, leading to higher transportation and storage costs. Therefore, reducing the packing volume of an electric bed without compromising its normal functionality becomes a technical challenge to be addressed in the industry.

SUMMARY OF THE INVENTION

The present invention has been accomplished in view of the above-noted circumstances. It is an objective of the present invention to provide a low-profile electric bed, which has a thin thickness, thereby reducing the packing volume thereof.

To attain the above and other objectives, the present invention provides a low-profile electric bed comprising a stationary frame having two slide rails, an upper frame, a push frame, and an actuator. The upper frame has a side pivotally connected with the stationary frame. The push frame comprises a swivel rack and two moving arms. The swivel rack includes a connecting rod and two support arms disposed with two ends of the connecting rod. Each of the two support arms is pivotally connected with the upper frame via a first pivot, pivotally connected with one of the two moving arms via a second pivot, and pivotally connected with a push wheel via a third pivot in a way that the third pivot is located between the first pivot and the second pivot, and the first, second and third pivots are located at three vertices of a triangle respectively. Each of the two support arms has a stopping portion configured in a way that when each of the two moving arms is rotated relative to associated one of the two support arms at a predetermined angle, each of the two moving arms is stopped at the stopping portion of the associated one of the two support arms to prevent the two moving arms from further rotation. Each of the two moving arms is pivotally connected with a roller via a fourth pivot. The actuator has two ends pivotally and respectively connected with the stationary frame and the swivel rack in a way that when the actuator gradually extends at a first stage, the two push wheels are in contact with the two slide rails respectively, causing the swivel rack to swing about the third pivot and to drive the upper frame to upward swing relative to the stationary frame, and when the actuator further extends at a second stage, the two moving arms are respectively engaged with the two stopping portions, causing that the two rollers are in contact with the two slide rails respectively, and the swivel rack and the two moving arms collectively swing about the fourth pivot in a way that the two push wheels are disengaged from the two slide rails, and the swivel rack and the two moving arms collectively drive the upper frame to upward further swing relative to the stationary frame. As a result, the low-profile electric bed may have a reduced thickness to minimize the packing volume without affecting the normal function.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
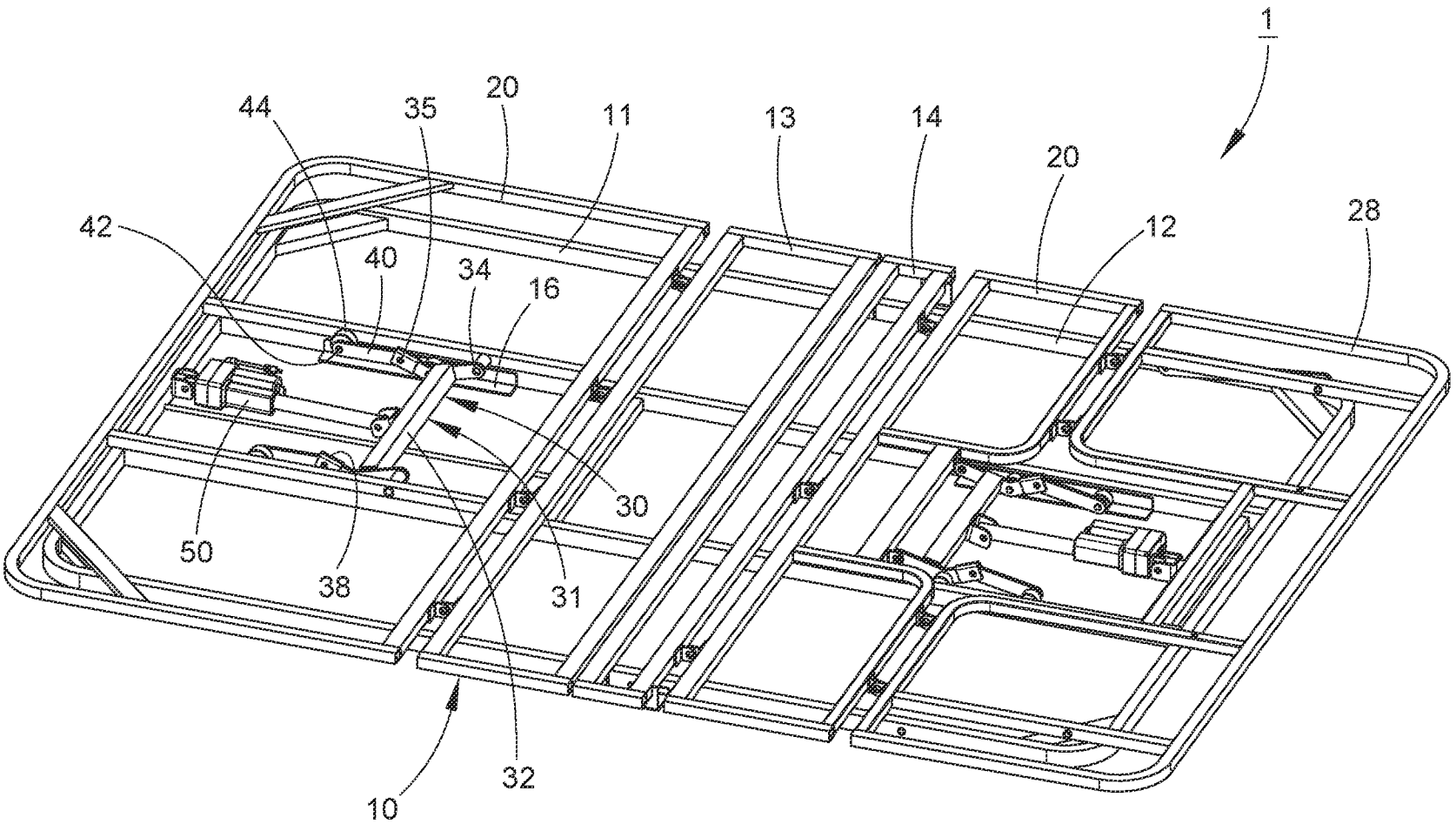
FIG. 1 is a perspective view of a low-profile electric bed according to an embodiment of the present invention.

The structure and technical features of the present invention will be detailedly described hereunder by an embodiment and accompany drawings. As shown in FIGS. 1-4, a low-profile electric bed 1 provided by an embodiment of the present invention is composed of a stationary frame 10, two upper frames 20, a lower leg supporting frame 28, two push frames 30, and two actuators 50.

The stationary frame 10 is the stationary part of the low-profile electric bed 1 during use, comprising a front base frame 11, a rear base frame 12 pivotally connected to the front base frame 11, a front buttock supporting frame 13 fixed to the top side of the front base frame 11, and a rear buttock supporting frame 14 fixed to the top side of the rear base frame 12. The front and rear buttock supporting frames 13 and 14 are used to support the mattress (not shown) at the user's buttock position. The stationary frame 10 has four slide rails 16 extending in a front-and-rear direction. In this embodiment, the so-called front-and-rear direction refers to the direction passing through the head and the tail of the bed. Two of these slide rails 16 are disposed on the front base frame 11, and the other two are located on the rear base frame 12.

The two upper frames 20 are respectively and pivotally connected on one side to the stationary frame 10. In this embodiment, one upper frame 20*a* serves as a back supporting frame, and is pivotally connected at its rear side to the front buttock supporting frame 13 and used to support a mattress for the user's back position. The other upper frame 20*b* serves as a thigh supporting frame, and is pivotally connected at its front side to the rear buttock supporting frame 14 and used to support the mattress for the user's thigh position. The lower leg supporting frame 28 is pivotally connected at its front side to the rear side of the thigh supporting frame. Since the two upper frames 20, the two push frames 30, and the two actuators 50 can be divided into two sets with the same structure, for simplification, the following description will use the back supporting frame as an example to illustrate the structural relationships between the upper frame 20 and other components.

Taking the push frame 30 located on the left side of FIG. 1 for example, the push frame 30 includes a swivel rack 31 and two moving arms 40. The swivel rack 31 has a connecting rod 32 extending in a left-and-right direction, and two support arms 33 extending in the front-and-rear direction and being connected with two ends of the connecting rod 32, respectively. Each support arm 33 is pivotally connected to the upper frame 20 via a first pivot 34, to an associated moving arm 40 via a second pivot 35, and to a push wheel 37 via a third pivot 36. The third pivot 36 is located between the first pivot 34 and the second pivot 35, and the first, second and third pivots 34, 35 and 36 form three vertices of an imaginary triangle T. Each of the two ends of the connecting rod 32 is positioned between paired one of the first pivots 34 and one of the third pivots 36. Each support arm 33 has a stopping portion 38 adjacent to the second pivot 35. When the moving arm 40 rotates relative to the associated support arm 33 to a predetermined angle, the moving arm 40 will be stopped by the stopping portion 38 to prevent the moving arm 40 from further rotation. Each moving arm 40 is pivotally connected to a roller 44 via a fourth pivot 42.

Figure 4:
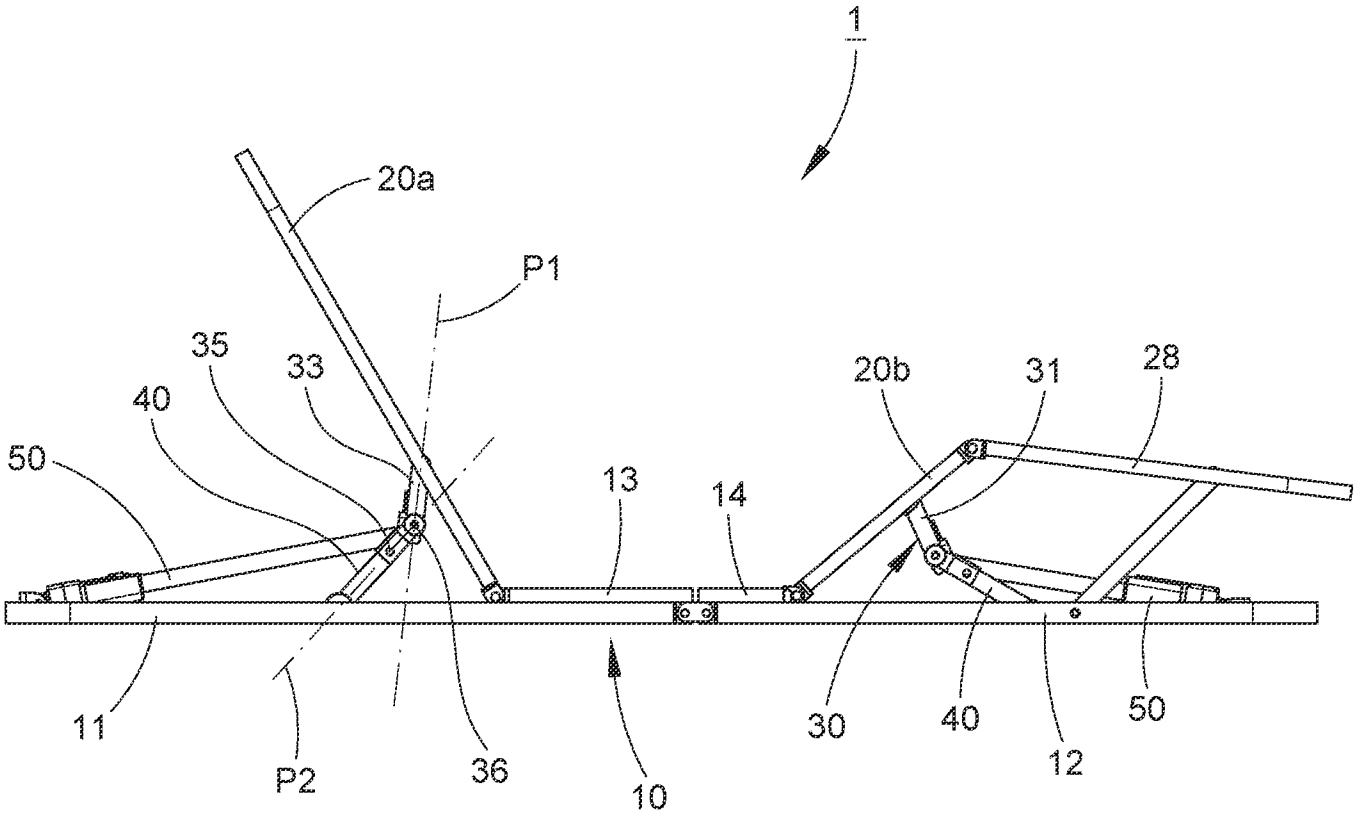
FIG. 4 is a schematic lateral view of the low-profile electric bed of the embodiment of the present invention, showing the electric bed is in use at the second stage.

As shown in FIG. 4, the first, second and third pivots 34, 35 and 36 are configured in a way that there is a first imaginary surface P1 passing through the first pivot 34 and the third pivot 36, and a second imaginary surface P2 passing through the second pivot 35 and the third pivot 36. Specifically, the first pivot 34 and the third pivot 36 are situated on the first imaginary surface P1, and the second pivot 35 and the third pivot 36 are situated on the second imaginary surface P2 that is defined with the first imaginary surface P1 an included angle ranging from 130° to 160°. In this embodiment, the aforesaid included angle is 144°; however, through actual testing, the included angle ranging from 130° to 160° may satisfy the requirement to achieve the same effective function. When the moving arm 40 swings upward and is stopped by the stopping portion 38, the fourth pivot 42 is just located on the second imaginary surface P2. However, in another embodiment, the position of the moving arm 40 relative to the swivel rack 31 is not restricted when the moving arm 40 is stopped by the stopping portion 38.

Regarding the actuator 50 located on the left side of FIG. 1, the actuator 50 is, in this embodiment, an electric cylinder, i.e., a rod type linear actuator, having two ends pivotally connected to the front base frame 11 of the stationary frame 10 and the connecting rod 32 of the swivel rack 31. In another embodiment, the actuator 50 may be realized as a pneumatic cylinder, hydraulic cylinder, or other suitable actuator, and moreover the actuator 50 may be pivotally connected to other parts of the swivel rack 31.

Figure 2:
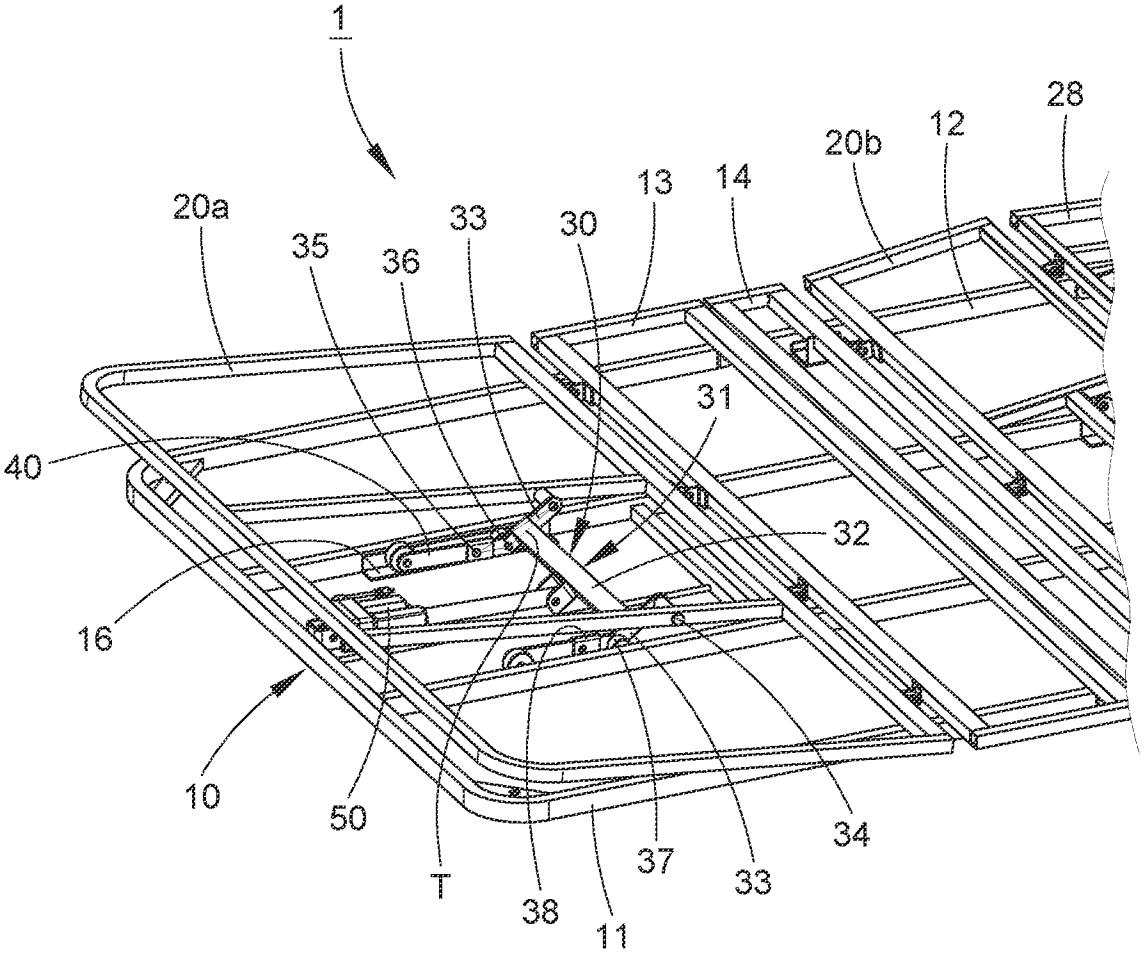
FIG. 2 is a schematic perspective view of the low-profile electric bed of the embodiment of the present invention, showing the electric bed is in use at a first stage.
Figure 3:
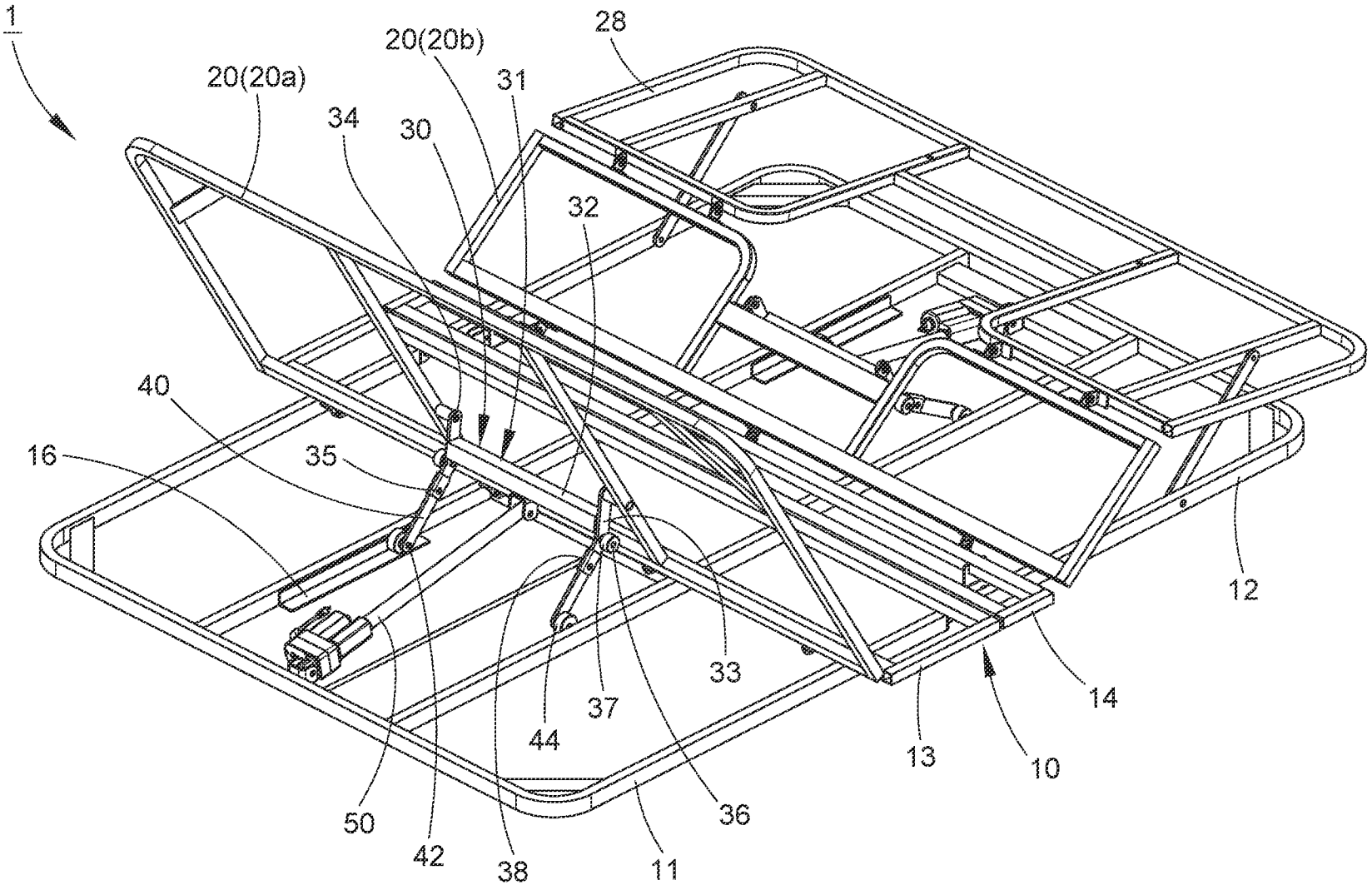
FIG. 3 is another schematic perspective view of the low-profile electric bed of the embodiment of the present invention, showing the electric bed is in use at a second stage.

In an initial state during actual operation, as shown in FIG. 1, the upper frame 20 is parallel to the stationary frame 10. At this state, the distance between the third pivot 36 and the slide rail 16 is less than the distance between the first pivot 34 and the slide rail 16 and less than the distance between the second pivot 35 and the slide rail 16. In other words, the third pivot 36 is closer to the slide rail 16 than the first pivot 34 and the second pivot 35 are, and the two push wheels 37 are in contact with the two slide rails 16. When the actuator 50 gradually extends to prolong its length, the two push wheels 37 maintain in contact with the two slide rails 16, causing the swivel rack 31 to swing about the third pivot 36 and simultaneously to drive the upper frame 20 to upward swing relative to the stationary frame 10, as shown in FIG. 2, representing the first stage. When the actuator 50 continuously extends to prolong its length further, the two moving arms 40 will swing relative to the two support arms 33 until the two moving arms 40 are stopped by the two stopping portions 38. At this point, the fourth pivots 42 are located on the second imaginary surface P2, the two rollers 44 are in contact with the two slide rails 16, and the swivel rack 31 and the two moving arms 40 collectively swing about the fourth pivots 42, causing that the two push wheels 37 are disengaged from the two slide rails 16, and the swivel rack 31 and the two moving arms 40 collectively drive the upper frame 20 to upward swing relative to the stationary frame 10, as shown in FIGS. 3 and 4, representing the second stage.

Figure 5:
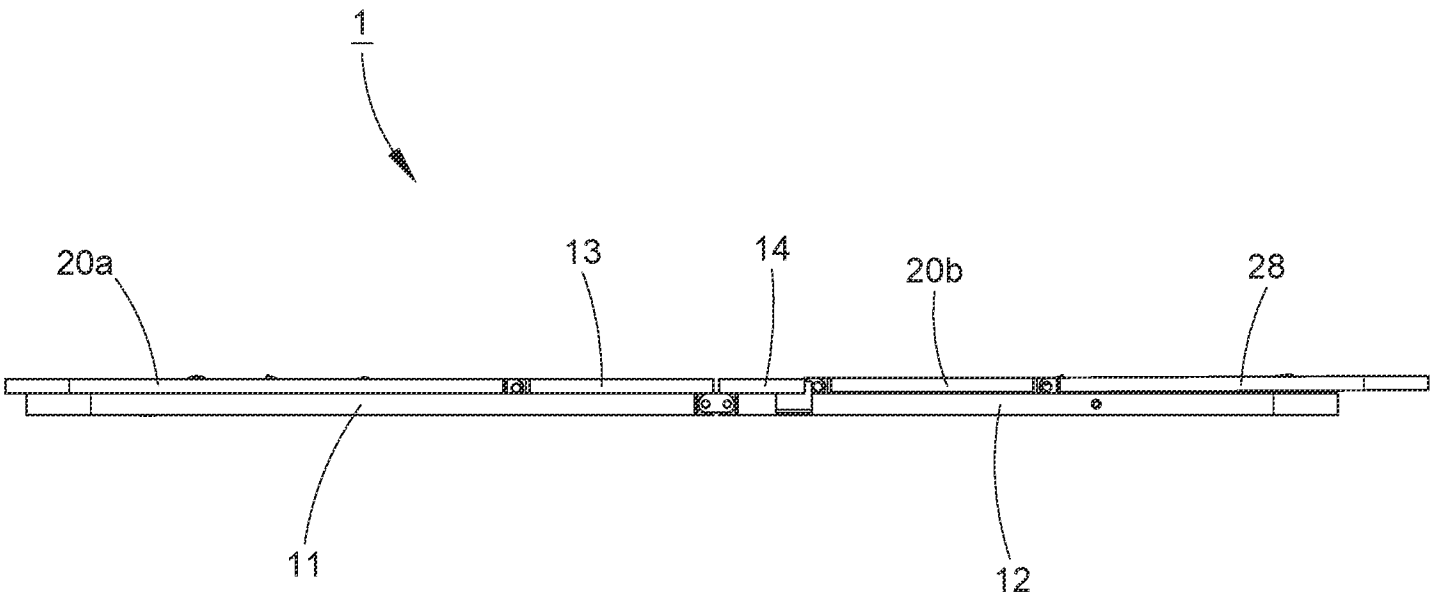
FIG. 5 is a lateral view of the low-profile electric bed of the embodiment of the present invention.

By means of the structural design of moveable joints of the push frame 30, the height of the push frame 30 can be limited between the bottom side of the stationary frame 10 and the top side of the upper frame 20. Without the need of using a larger actuator, sufficient torque can be applied to drive the upper frame 20 to swing upward. This design allows the overall thickness of the low-profile electric bed 1 to be only about 5-6 centimeters, as shown in FIG. 5. Compared to conventional structures of prior arts, the low-profile electric bed 1 provided by the present invention effectively reduces the overall thickness thereof so as to minimize the packing volume thereof, thereby achieving the objectives of the present invention.

Based on the technical features of the present invention, various modifications to the low-profile electric bed 1 may be made. For example, the shapes of the stationary frame 10 and the upper frame 20 may be changed, and the connecting rod 32 may have a different shape, such as a plate shape, as long as it can connect the two support arms 33. Such variations are not to be regarded as a departure from the spirit and scope of the invention, and all such modifications as would be obvious to one skilled in the art are intended to be included within the scope of the following claims.

What is claimed is:

1. A low-profile electric bed, comprising:

a stationary frame having two slide rails;

an upper frame having a side pivotally connected with the stationary frame;

a push frame comprising a swivel rack and two moving arms; wherein the swivel rack includes a connecting rod and two support arms disposed with two ends of the connecting rod; wherein each of the two support arms is pivotally connected with the upper frame via a first pivot, pivotally connected with one of the two moving arms via a second pivot, and pivotally connected with a push wheel via a third pivot in a way that the third pivot is located between the first pivot and the second pivot, and the first, second and third pivots are located at three vertices of a triangle respectively; wherein each of the two support arms has a stopping portion configured in a way that when each of the two moving arms is rotated relative to associated one of the two support arms at a predetermined angle, the each of the two moving arms is stopped at the stopping portion of the associated one of the two support arms to prevent the each of the two moving arms from further rotation; wherein each of the two moving arms is pivotally connected with a roller via a fourth pivot; and an actuator having two ends pivotally and respectively connected with the stationary frame and the swivel rack in a way that when the actuator gradually extends at a first stage, the two push wheels are in contact with the two slide rails respectively, causing the swivel rack to swing about the third pivot and to drive the upper frame to upward swing relative to the stationary frame, and when the actuator further extends at a second stage, the two moving arms are respectively engaged with the two stopping portions, causing that the two rollers are in contact with the two slide rails respectively, and the swivel rack and the two moving arms collectively swing about the fourth pivot in a way that the two push wheels are disengaged from the two slide rails, and the swivel rack and the two moving arms collectively drive the upper frame to upward further swing relative to the stationary frame.

2. The low-profile electric bed as claimed on claim 1, wherein one of the two ends of the actuator is pivotally connected with the connecting rod of the swivel rack; each of the two ends of the connecting rod is located between one of the two first pivots and one of the two third pivots.

3. The low-profile electric bed as claimed in claim 1, wherein when the upper frame is parallel to the stationary frame, a distance between the third pivot and the slide rail is less than a distance between the first pivot and the slide rail and less than a distance between the second pivot and the slide rail.

4. The low-profile electric bed as claimed in claim 1, wherein the first pivot and the third pivot are situated on a first imaginary surface, and the second pivot and the third pivot are situated on a second imaginary surface that is defined with the first imaginary surface an included angle ranging from 130° to 160°.

5. The low-profile electric bed as claimed in claim 4, wherein when the moving arm is stopped by the stopping portion, the fourth pivot is situated on the second imaginary surface.

* * * * *